US006161266A

United States Patent [19]

Anscher

[11] Patent Number: 6,161,266

[45] Date of Patent: Dec. 19, 2000

[54] MODULAR ATTACHMENT SYSTEM

[75] Inventor: Joseph Anscher, Muttontown, N.Y.

[73] Assignee: National Molding Corporation, Farmingdale, N.Y.

[21] Appl. No.: 09/252,178

[22] Filed: Feb. 18, 1999

[51] Int. Cl.[7] ..... A44B 11/25; A44B 15/00

[52] U.S. Cl. ..... 24/625; 24/3.6; 24/615; 24/616

[58] Field of Search ..... 24/625, 615, 616, 24/606, 590, 3.1, 3.6

[56] References Cited

U.S. PATENT DOCUMENTS

| | | | |
|---|---|---|---|
| 3,600,917 | 8/1971 | Krock | 24/615 |
| 4,319,384 | 3/1982 | Horne | 24/3.6 |
| 4,932,362 | 6/1990 | Birchmire, III et al. | 119/96 |
| 5,148,582 | 9/1992 | Dennis, Jr. | 24/625 |
| 5,379,496 | 1/1995 | Krauss | 24/615 |
| 5,832,573 | 11/1998 | Howell | 24/616 |

FOREIGN PATENT DOCUMENTS

| | | | |
|---|---|---|---|
| 2268050 | 1/1994 | United Kingdom | 24/3.6 |

*Primary Examiner*—Victor N. Sakran
*Attorney, Agent, or Firm*—Kenyon & Kenyon

[57] ABSTRACT

A modular attachment system for an object holding/displaying system comprises a base module that engages a cord and an attachment module that engages an attachment device used to hold/display an object. Various types of attachment modules may be used with a single base module, thus allowing substitution and flexibility in providing appropriate systems for various situations. The base module and attachment module are releasably connected to facilitate easy substitution. Various attachment devices may be used with the attachment module. The base module may also include a safety release system to allow the cord to disengage in the presence of a strong force. The attachment system may be made from molded plastic.

28 Claims, 15 Drawing Sheets

MODULAR ATTACHMENT SYSTEM

FIELD OF THE INVENTION

The present invention is directed to attachment systems for the holding and/or display of objects. More specifically, the present invention provides a modular attachment system for use in, for example, the holding and display of various objects, such as hats, identification badges, keys and similar objects.

BACKGROUND INFORMATION

Systems are known for the holding and display of objects such as hats, badges, whistles, keys, and so forth. These systems generally comprise a cord web, lanyard or similar wire-type material that may be worn by a person, for example, around the neck or around the wrist. Attached to the cord is an attachment piece, such as an alligator clip or a hook, for holding various objects. For example, in the case of an alligator clip, a badge or other object to be displayed can be secured by the alligator clip, or a hat may be secured to prevent loss if knocked off a person's head. Also, in the case of a hook, a whistle or keys can be attached to the hook.

These holding/display systems are inflexible, in that they are necessarily limited to a single type of attachment piece per system. For example, the prior art attachment system may use a clip hook attached to a webbing by crimping, thus permanently attaching the clip hook to the webbing. In such a case, a manufacturer that would like to provide display systems for badges and also provide hat keepers would need to manufacture entirely separate systems for each purpose. The manufacturer will thus be unable to flexibly respond to demand for any specific type of display/holding system, and a user will be forced to purchase multiple systems for each circumstance. Furthermore, these holding/display systems pose the danger of injury to wearers, should the object being held become caught, for example, in a piece of machinery.

SUMMARY OF THE INVENTION

An exemplary embodiment according to the present invention is a modular holding/display system that allows different attachment modules to be used with a single base module and cordage combination. An attachment module (which includes an apparatus for implementing a desired holding and/or displaying function, such as a ring or a clip hook) is coupled to a base module, which is in turn coupled to a cord, webbing, wire or the like, for wearing by a user. Since multiple attachment modules can be used with the single base module, a display/holding system can be provided according to the present invention with flexibility for use in various situations.

The exemplary base module and exemplary attachment module are coupled via a male-female releasable buckle interface (for example, a side-release buckle), allowing for the substitution of different attachment modules for a single base module without disassembly of either the base module or the attachment module. Furthermore, the base module may include a safety release ("break-away") system that allows the cordage coupled to the base module to disengage from the base module upon the application of a strong abrupt force (e.g., an I.D. tag being drawn into a piece of machinery). A flexible and safe holding/display system is thereby accomplished.

DETAILED DESCRIPTION OF THE DRAWINGS

Figure 1:
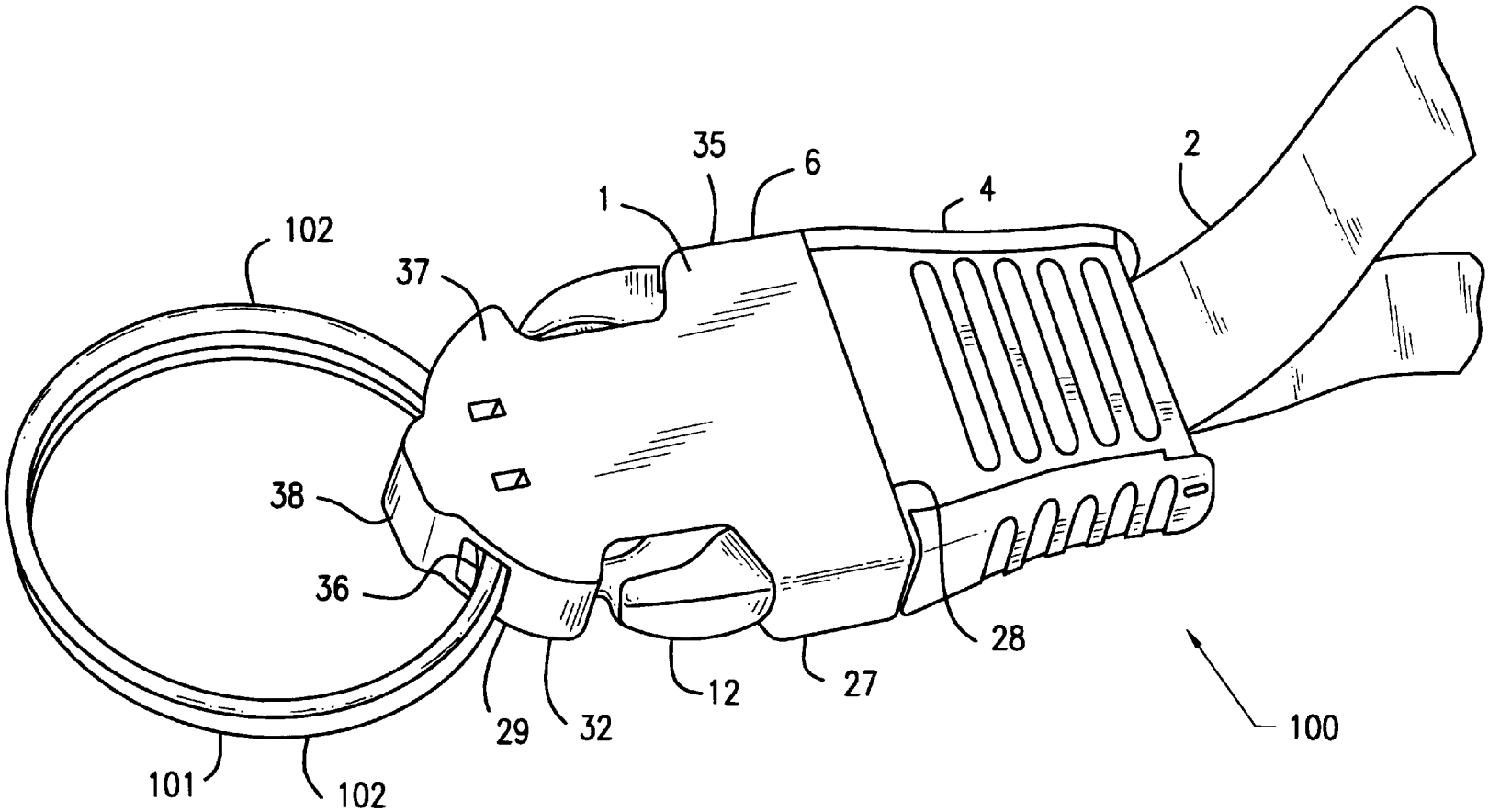
FIG. 1 shows a perspective view of a modular attachment system according to the present invention.

FIGS. 1–18 illustrate an exemplary embodiment of a modular attachment system according to the present invention. A modular system 1 is connected to cordage 2 as part of an object holding system 100. Modular system 1 includes base module 4 and attachment module 6. The attachment module 6 includes an attachment device 101—in the case of FIG. 1, the attachment device 101 is a metal split ring 102. As further described below, other types of attachment devices 101 may be used in conjunction with attachment module 6. Cordage 2 may comprise a webbing, wire, lanyard, cord or other similar material to allow a user to hold and/or wear the object holding system 100.

Figure 3:
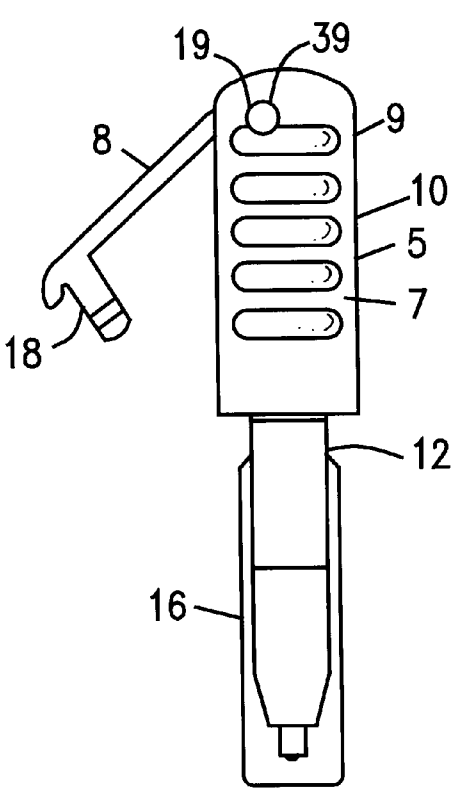
FIG. 3 shows a side view of the exemplary base module of FIG. 2.
Figure 2:
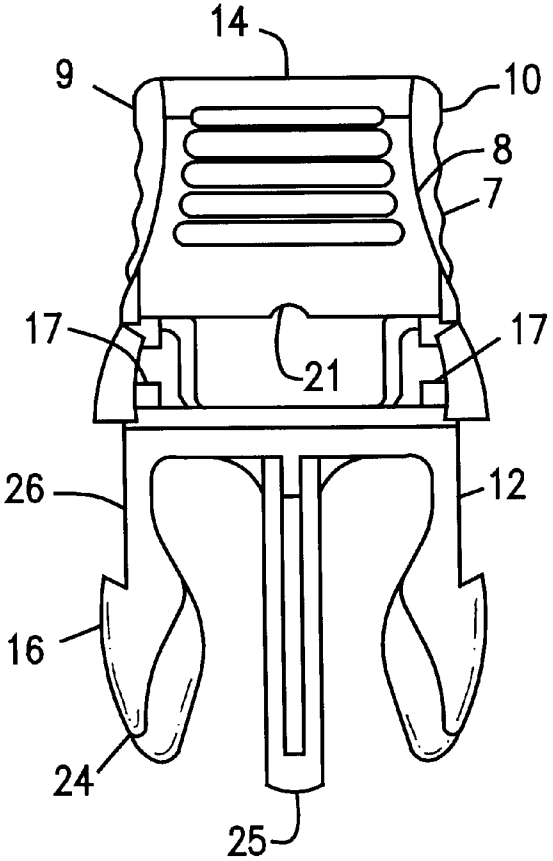
FIG. 2 shows a front view of an exemplary base module of the modular attachment system of FIG. 1.
Figure 5:
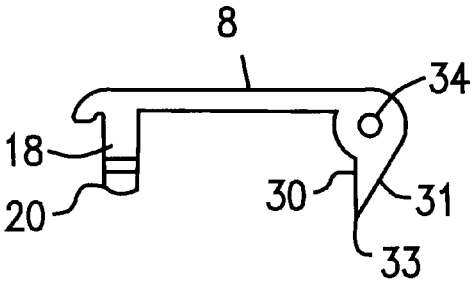
FIG. 5 shows a side view of an exemplary top piece of the exemplary base module of FIG. 2.

A first exemplary base module 4 for use in the modular system 1 is further illustrated in FIGS. 2–5. Base module 4 comprises a cord connection section 10 and an attachment module mating section 12. Exemplary cord connection section 10 is located at a top end 14 of the base module 4, and includes a top piece 8 and base 9. Top piece 8 and base 9 are pivotally interconnected via a pivot system 19, such that the top piece 8 is rotatable between an open and a closed position (FIGS. 2 and 3 show the top piece 8 in the open position). Pivot system 19 may comprise any known configuration for effecting a rotational function. As shown in FIGS. 3 and 5, the pivot system 19 comprises two pins 34, each of which extrudes laterally from a respective side of the top piece 8, so as to engage mating holes 39 formed in each side wall 7 of base 9. Pivot system 19 may also comprise a hinge (as is further described below).

As further described below, when the top piece 8 is moved to the closed position, the top piece 8 becomes interlocked with the base 9, and, if a cordage 2 is present, causes the cordage 2 to become tightly coupled to the base module 4.

Coupling of cordage 2 to the exemplary base module 4 is achieved first by inserting cordage 2 into the cord connection section 10. Top piece 8 includes a crimping arm 30 disposed toward the top end 14 of the base module 4 and extending toward the base 9 (see FIG. 5). Crimping arm 30 includes a negatively sloping face 31, which tapers the crimping arm 30 to a crimping point 33. When the top piece 8 is moved into the closed position, the crimping point 33 of crimping arm 30 impinges upon that portion of cordage 2 that has been inserted into the cord connection section 10. This impingement places pressure on the cordage 2 at the point of contact, creating a frictional coupling. Additionally, any pulling force applied to cordage 2 will be realized as a downward force on the top piece 8 by virtue of the fulcrum effect of the pivot system 19, further aiding in the coupling effect. Negatively sloped face 31 of crimping arm 30 augments the fulcrum effect.

Top piece 8 further includes locking arms 18, which each include a locking tooth 20. The locking arms 18 extend inwardly toward the base 9 and are arranged to engage respective locking cavities 17 disposed in a back wall 5 of the base 9. When the top piece 8 is moved to the closed position, locking arms 18 engage locking cavities 17, such that locking teeth 20 become lodged within cavities 17. Top piece 8 further includes a notch 21, which may be used to unlock top piece 8, for example, by allowing a pin to be inserted into the cord connection section 10 so that the top piece 8 may be pried into the open position.

Figure 17:
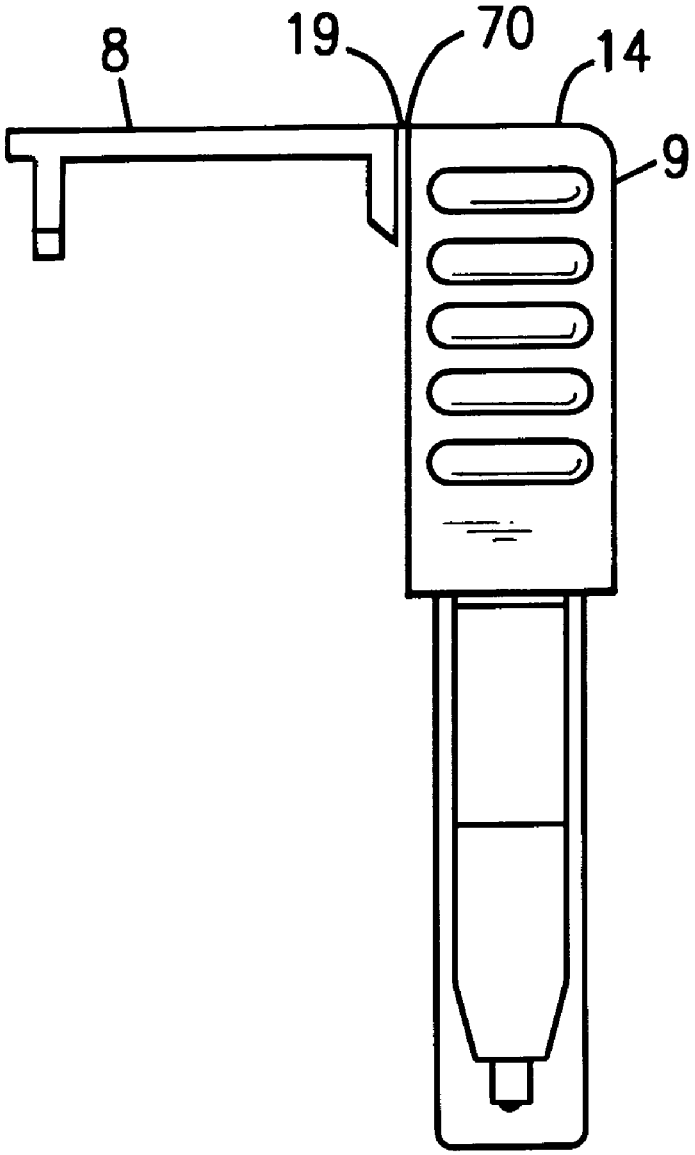
FIG. 17 shows a side view of a base module having an alternative pivot system, according to the present invention.

The exemplary base module 4 may alternatively use a pivot system 19 such as illustrated in FIG. 17, wherein a hinge 70 is formed between top piece 8 and base 9 at the top end 14 of the base module 4. Hinge 70 may be formed, for example, where top piece 8 and base 9 are molded from the same plastic material, and the thickness of the plastic material is reduced at the point where hinge 70 is to be formed in order to form an area of flexibility. In such a configuration, top piece 8 no longer includes pins 34, and base 9 no longer includes mating holes 39. The operation of the cord connection section 10 using this arrangement is otherwise identical to the operation using the pins/holes arrangement described above.

Figure 4:
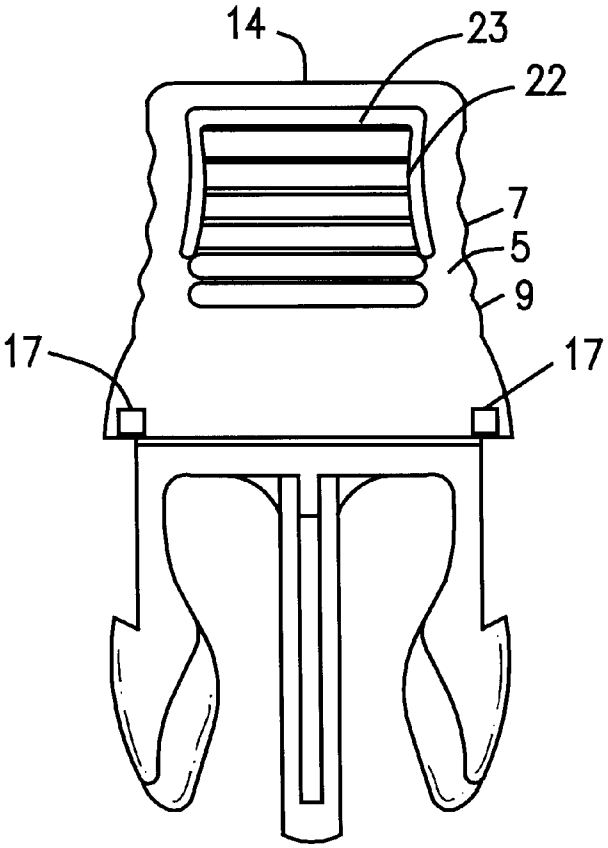
FIG. 4 shows a back view of the exemplary base module of FIG. 2.

The exemplary cord connection section 10 described above allows for the use of a safety release system for when an overly strong force is applied to cordage 2. Such an arrangement may prevent the wearer of the object holding/display system from becoming injured should the system become entangled, e.g. preventing possible strangulation should a badge that is being worn around the neck become caught in a piece of machinery, car door, ski lift, and so forth. As shown in FIG. 4, the exemplary cord connection section 10 may include a tab 22 formed by an open slotted area 23 in the back side 5 of the base 9. Tab 22 is positioned such that the crimping point 33 of crimping arm 30 opposes tab 22 when the top piece 8 is in the closed position. Thus, when a cordage 2 has been inserted into cord connection section 10 and the top piece 8 is moved to the closed position, the cordage 2 is impressed against tab 22 via the impingement of the crimping point 33, causing a frictional coupling. However, if a strong sudden force is applied to the cordage 2, the tab 22 will tend to deflect outwardly (away from crimping point 33), allowing the cordage 2 to escape the cord connection section 10.

The attachment module mating section 12 is connected to the cord connection section 10 and disposed at a bottom end 16 of the base module 4. The attachment module mating section 12 and cord connection section 10 may be formed from the same molded plastic material. As shown by FIGS. 1–4, the exemplary attachment module mating section 12 comprises a male side-releasable buckle clip 26 having locking arms 24 and central member 25. Such side-release buckle clips are well known. Note that base module 4 may alternately use a female side-releasable buckle clip. Also note that other releasably attachable clipping devices may be used for attachment module mating section 12, for example, a center-push-button-type releasable clip, as is well known in the art.

A first embodiment of an exemplary attachment module 6 is shown in FIG. 1. Attachment module 6 includes a base module mating section 27 at a top end 28 of the attachment module 6 and an attachment device mating section 29 at a bottom end 32 of the attachment module 6. Base module mating section 27 is a female side-release buckle clip 35, which corresponds to the male side-release buckle clip 26 of base module 4, the design of which is also well known. Note that the base module mating section 27 will correspond to the particular type of attachment module mating section 12 used in the base module 4, so that other types of base module mating sections 27 are possible. Attachment module 6 may be releasably coupled to base module 4 via engagement of the base module mating section 27 with the attachment module mating section 12 of the base module 4, as is depicted in FIG. 1.

Attachment device mating section 29 is used to couple the attachment module 6 to a desired attachment device 101. As depicted in FIG. 1, a first exemplary attachment device mating area 29 comprises upper and lower plates 37 and bottom end 38, which are arranged to form a side through-channel 36 which may accommodate, for example, a metal-split ring 102. Ring 102 may be fed into the side through-channel 36 in a typical manner, e.g., separating and feeding the ring 102 into the side through-channel 36 until completely within the side through-channel 36.

Figure 6:
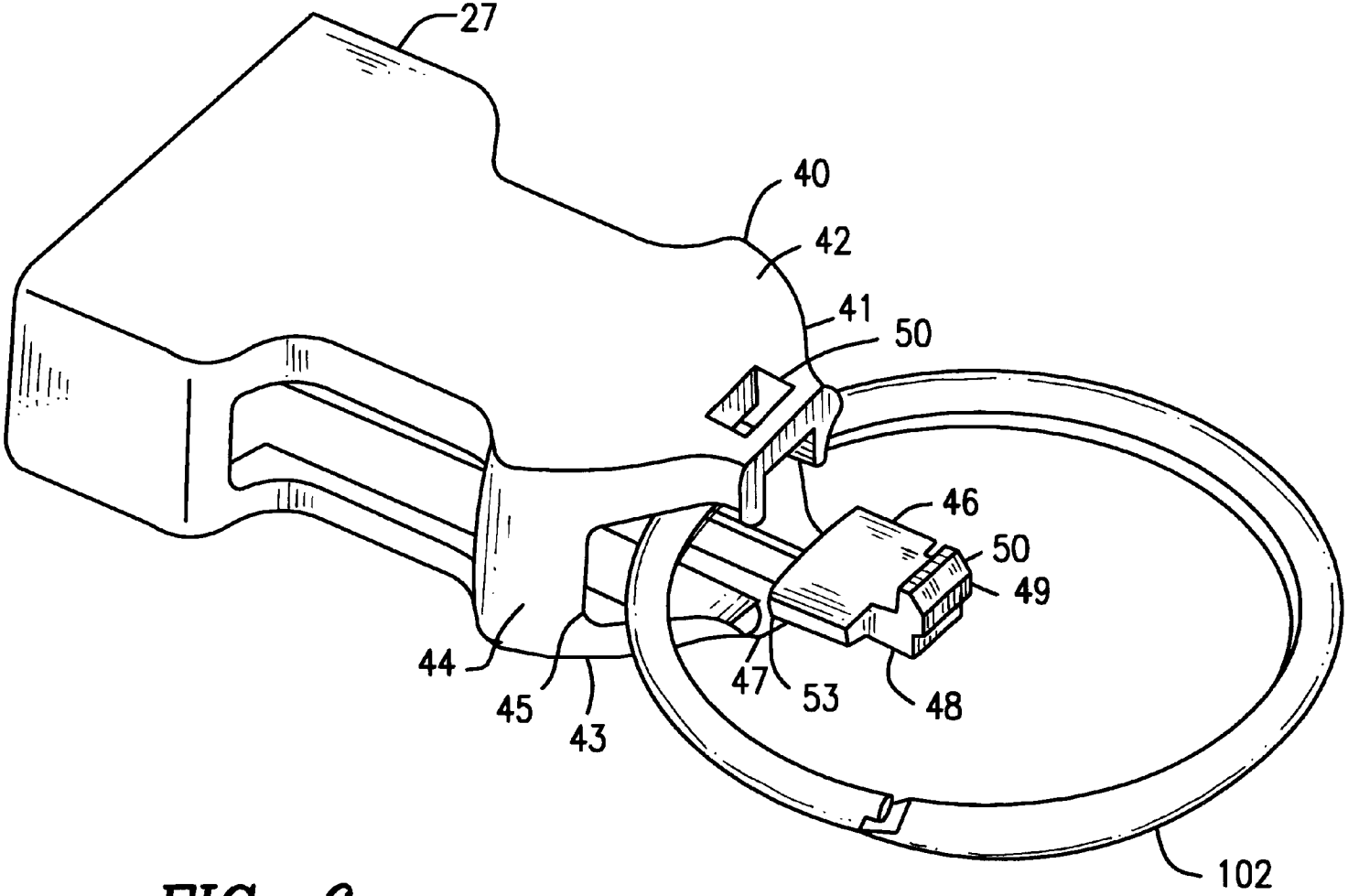
FIG. 6 shows a perspective view of a second exemplary attachment module according to the present invention.
Figure 7:
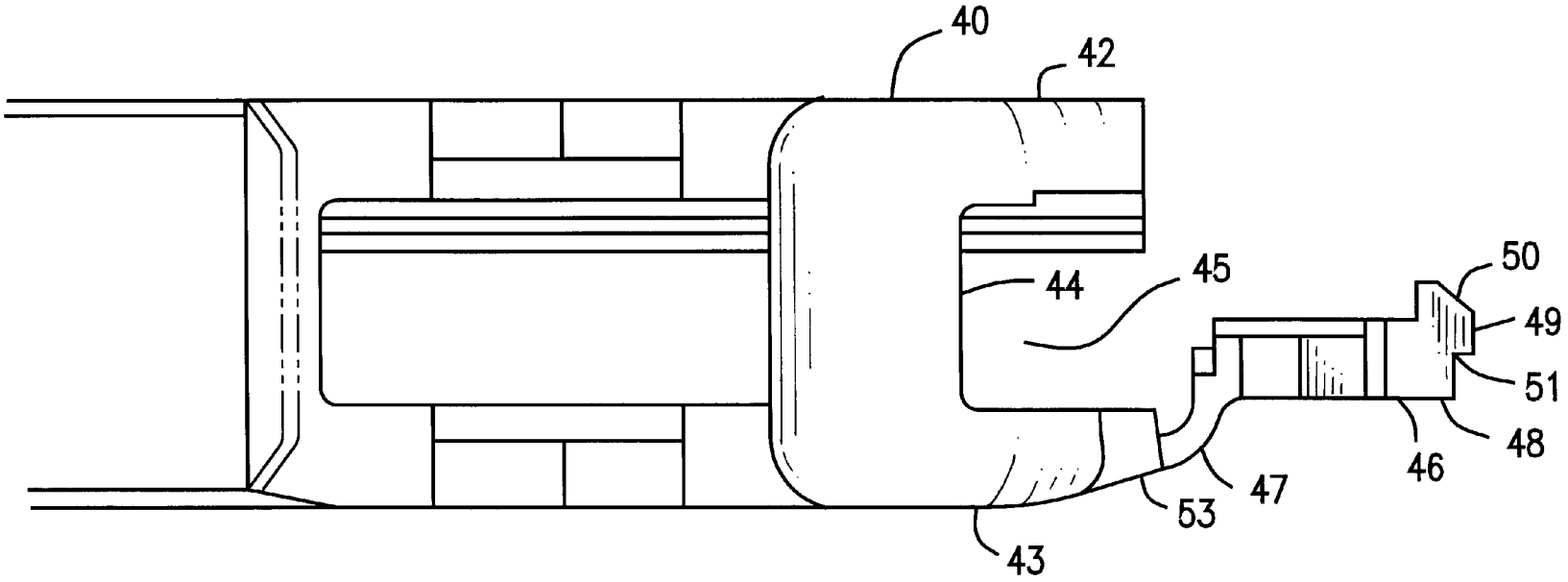
FIG. 7 shows a side view of the second exemplary attachment module of FIG. 6.

A second exemplary embodiment of the attachment module 6 is shown by FIGS. 6–7. This second embodiment of attachment module 6 also comprises a base module mating section 27 that is a female side-releasable buckle clip, but includes an attachment device mating section 40 that provides a "hinged through-channel" arrangement to allow the securing of the attachment device 101. Attachment device mating section 40 includes a base 41 that extends from the base module attachment section 27. Base 41 comprises upper and lower plates 42, 43, which extend substantially parallel to each other from the base module mating section 27. Base 41 may further includes sides 44 which extend from base module mating section 27 on opposite sides and substantially perpendicular to the upper and lower plates 42, 43. Sides 44 do not extend as far as upper and lower plates 42, 43, thus defining a side through-channel 45.

A hinge piece 46 is connected to the bottom end 53 of lower plate 43. Hinge piece 46 is connected to the lower plate 43 via hinge 47, which may be a separate element or, where lower plate 43 and hinge piece 46 are formed from a single molded plastic substance, an area of increased flexibility between the two. Hinge piece 46 includes a tab 48 at a bottom end thereof, the tab 48 having a tooth 49 with a sloped front face 50 and a perpendicular back face 51. As described further below, tooth 49 may be used to secure the hinge piece 46 in a locked position, thereby securing an attachment device 101 (such as ring 102) to the attachment module 6. Upper plate 42 includes at its lower end a notch 50 arranged to mate with the tooth 49.

The operation of the hinge piece 46 to secure, for example, a ring 102 is now described. With the hinge piece 46 in the open position (parallel to lower plate 43), ring 102 is inserted into the channel 45 (see FIG. 6). The hinge piece 46 is then moved from the open position to a position perpendicular to the lower plate, causing the sloped front face 50 of tooth 49 to contact the upper plate 42. The sloped face allows the hinge piece 46 to continue to be moved toward the perpendicular position (although with resistance from the upper plate 42) until the tooth becomes lodged in the notch 50. Once the tooth 49 enters the notch 50, the hinge piece 46 is in a locked position, forming a wall to prevent the ring from being removed from the channel 45. The perpendicular back face 51 of tooth 49 prevents the hinge piece 46 from being moved back to the open position, effectively locking the hinge piece 46 in place.

Figure 8:
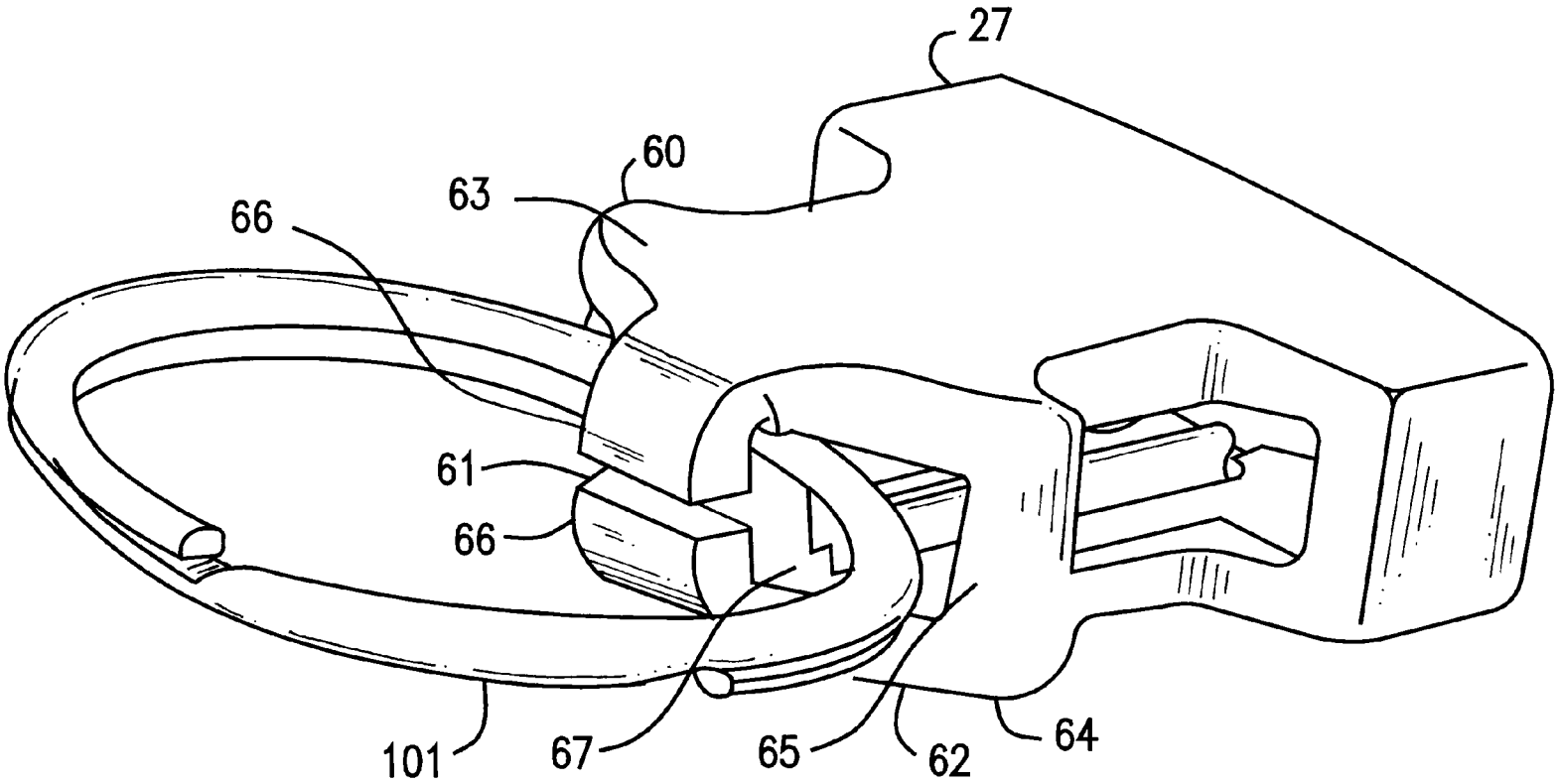
FIG. 8 shows a perspective view of a third exemplary attachment module according to the present invention.

A third exemplary embodiment of the attachment module 6 is shown by FIG. 8. This third embodiment of attachment module 6 also comprises a base module mating section 27 that is a female side-releasable buckle clip, but includes a third exemplary attachment device mating section 60 that provides a "snap through-channel" arrangement to allow the securing of the attachment device 101. This snap through-channel arrangement is similar in many respects to the hinged through-channel arrangement of the second exemplary attachment module 6, but replaces the hinge piece 46 with a narrow gap 61 to secure the attachment device 101. Accordingly, attachment device mating section 60 includes a base 62 that extends from the base module attachment section 27. Base 62 comprises upper and lower plates 63, 64, which extend substantially parallel to each other from the base module mating section 27. Base 62 further includes sides 65 which extend from base module mating section 27 on opposite sides and substantially perpendicular to the upper and lower plates 63, 64. Sides 65 do not extend as far as upper and low plates 63, 64, thus defining a side through-channel 67.

Base 62 further includes upper and lower tabs 66, 68 which extend from the upper plate 63 and lower plate 64, respectively, at the lower ends of each. Tabs 66, 68 extend substantially perpendicularly from the upper and lower plates 63, 64 in opposing fashion, such that a narrow gap 61 is defined between the tabs 66, 68. Tabs 66, 68 are integrated with the base 62, for example, as part of the same molded plastic material as forms base 62, such that tabs 66, 68 are resiliently deflectable to expand the width of narrow gap 61.

In operation, an attachment device 101 may be secured in the attachment device mating section 60 by inserting the attachment device 101 (for example, a ring 102 as depicted in FIG. 8) through the narrow gap 61 into channel 67. Ring 102 has a ring thickness that is thicker than the width of narrow gap 61, however, upon forceful insertion of ring 102, the tabs 66, 68 flex outwardly, allowing the ring 102 to pass into the channel 67. Once the ring 102 has entered the channel 67, the tabs 66, 68 return to their original state, forming the narrow gap 61 at a width again smaller than the ring thickness, thus preventing the ring from exiting the attachment device mating section 60.

Figure 9:
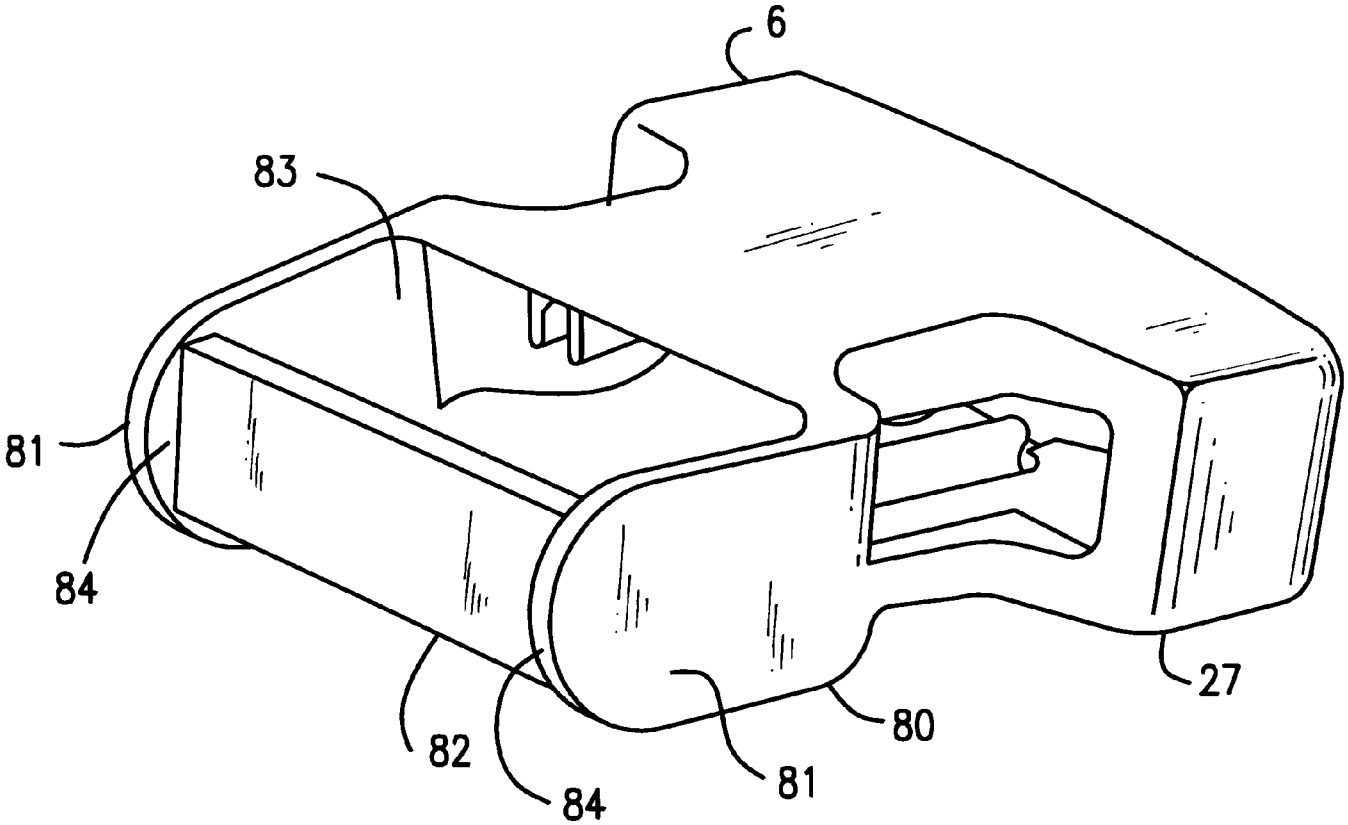
FIG. 9 shows a first perspective view of a fourth exemplary attachment module according to the present invention.
Figure 10:
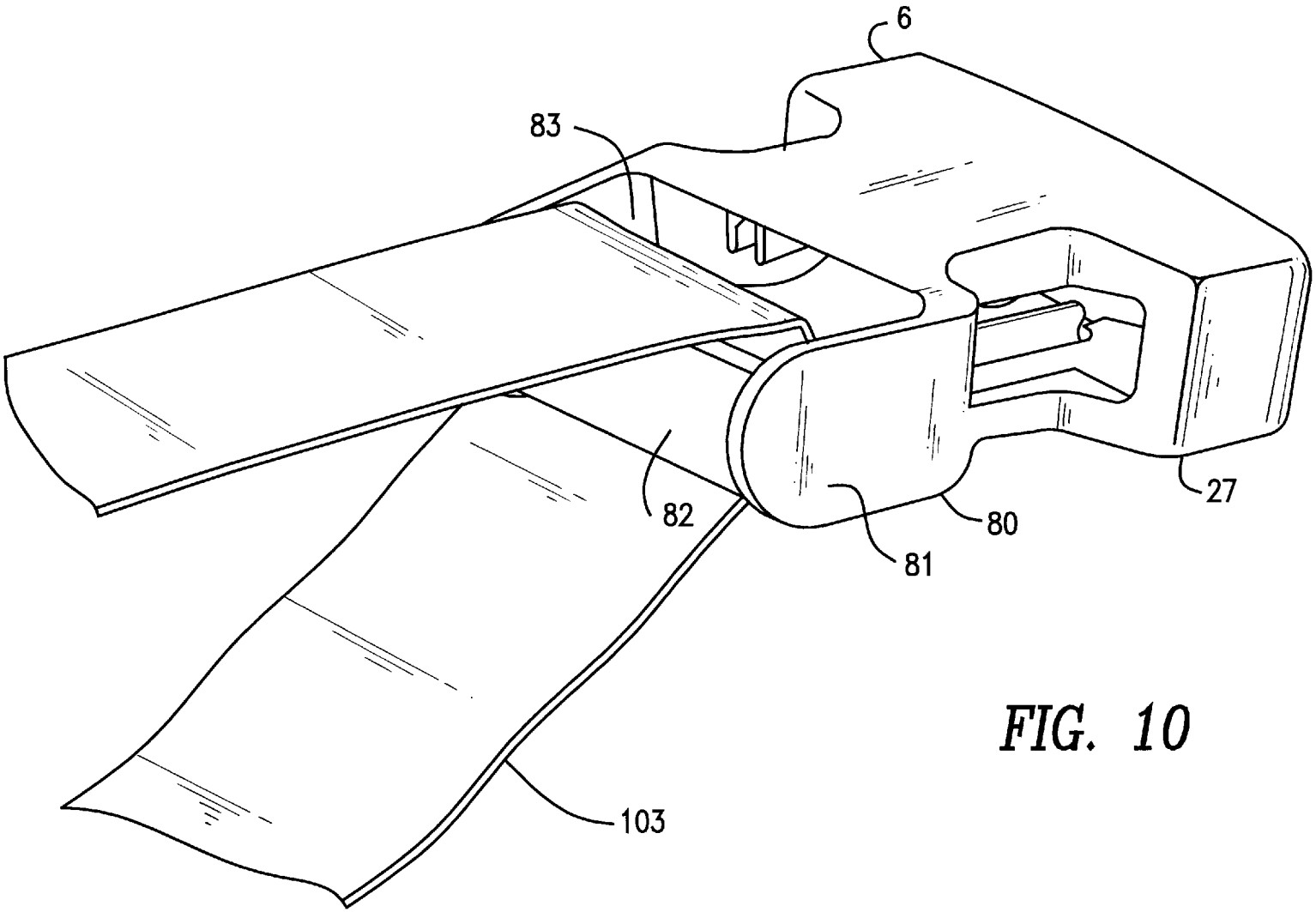
FIG. 10 shows a second perspective view of the fourth exemplary attachment module of FIG. 9.

A fourth exemplary embodiment of the attachment module 6 is shown by FIGS. 9–10. This fourth embodiment of attachment module 6 also comprises a base module mating section 27 that is a female side-releasable buckle clip, but includes a fourth exemplary attachment device mating section 80 that is a loop arrangement to allow the securing of an attachment device 101, such as a webbing 103. Attachment device mating section 80 includes sides 81 which extend from base module mating section 27 on opposite sides, as shown in FIG. 9. A bar 82 is coupled to the lower ends 84 of each side 81, forming a loop region 83. Sides 81 and bar 82 may be formed integrally with the base module mating section 27 as part of a single molding process. According to this fourth embodiment of the attachment module 6 according to the present invention, an attachment device such as a webbing 103 may be inserted into the loop region 83, such that webbing 103 "loops around" bar 83 (see FIG. 10). Webbing 103 may thereafter be applied to another element (such as a ring, clip or loop) and sealed together (for example, by stitching or adhesive) to prevent the webbing 103 from escaping from attachment device mating section 80.

Figure 11:
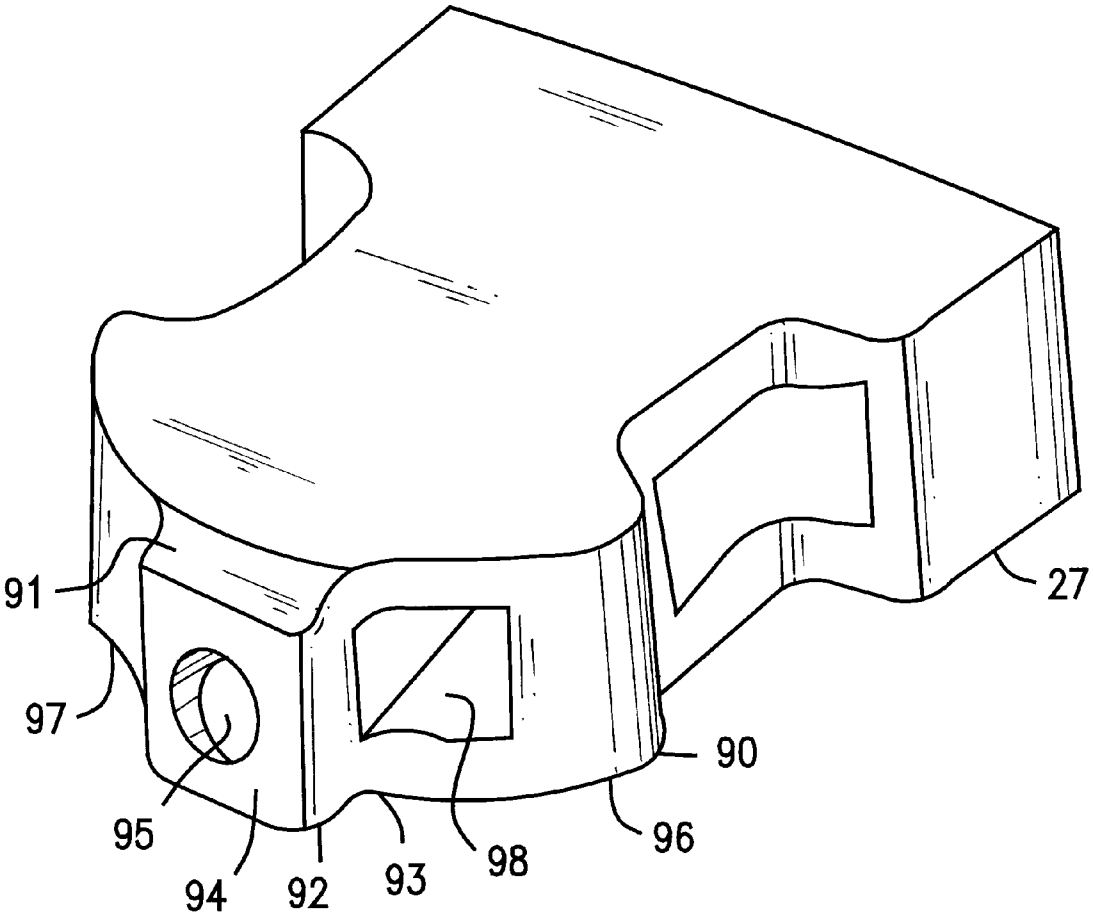
FIG. 11 shows a perspective view of a fifth exemplary embodiment of an attachment module according to the present invention.

A fifth exemplary embodiment of the attachment module 6 is shown by FIG. 11. This fifth embodiment of attachment module 6 also comprises a base module mating section 27 that is a female side-releasable buckle clip, but includes an exemplary attachment device mating section 90 that is a "front through-hole" arrangement to allow the securing of various attachment devices 101. The attachment device mating section 90 comprises an upper plate 91 and a lower plate 92 extending from base module mating section 27 towards a bottom end 93 of the attachment module 6. At bottom end 93 of the attachment module 6, a bottom plate 94 is connected to the upper plate 91 and the lower plate 92. The bottom plate 94 includes a through-hole 95. The attachment device mating section 90 may further comprise sides 96, 97 which extend from the base module mating section 27 perpendicular to the upper and lower plates 91,92. Sides 96,97 may extend only partially towards bottom plate 94, leaving an open area 98 for access to the interior of the attachment module 6.

Figure 13:
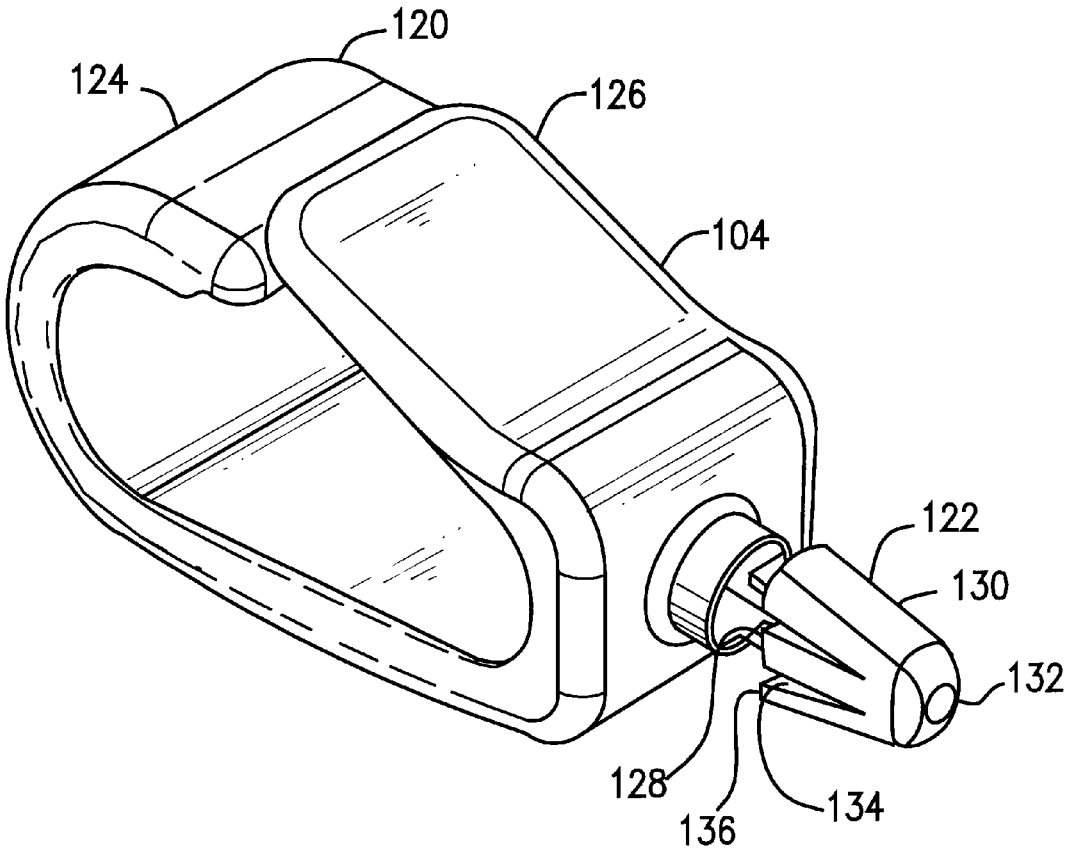
FIG. 13 shows a perspective view of the clip hook of FIG. 12.

The attachment device mating section 90 may be used with a variety of attachment devices 101 that can be engaged with this fifth exemplary attachment module 6 via the through-hole 95. For example, a clip hook may be used as an attachment device 101 coupled to the attachment module 6. FIG. 13 illustrates an exemplary clip hook 104. Clip hook 104 includes a clip section 120 and a "post-wing" mating section 122. Clip section 120 comprises a hook 124 and a clip arm 126, which may be engaged to secure various objects within the clip section 120 (for example, an identification badge). Post-wing mating section 122 comprises a post 128 extending outwardly from clip section 120 and wings 130 connected to a tip 132 of the post 128. Wings 130 extend backwardly toward the clip section 120 at an angle to post 128, such that a gap 134 is formed between the post 128 and each wing 130 at a back end 136 of each wing 134. Each wing 130 is deflectable such that it may be deflected inwardly towards post 128 to eliminate the gap 134. When in the static (undeflected) position, the back ends 136 of the wings 130 present a cross-section that is wider than the width of the through-hole 95 of the attachment mating section 90.

In order to connect the exemplary clip hook 104 to the fifth exemplary attachment module, the mating section 122 of clip hook 104 is inserted into the through-hole 95 of attachment device mating section 90. Initially, wings 130 contact the rim of through-hole 95, but do not pass through the through-hole 95, as the back ends 136 of each wing 130 present a wider cross-section than the through-hole 95 can accommodate. However, as the mating section 122 is inserted into the through-hole 95, the wings 130 are deflected inwardly toward the post 128, thereby reducing the cross-section presented to the through-hole 95, and eventually allowing the wings 130 to pass into the attachment module 6. Once the wings 130 have cleared the through-hole 95, the wings 130 return to their original positions, again providing a cross-section wider than the through-hole 95, and thus preventing disengagement of the clip hook 104 from the attachment module 6.

Figure 12:
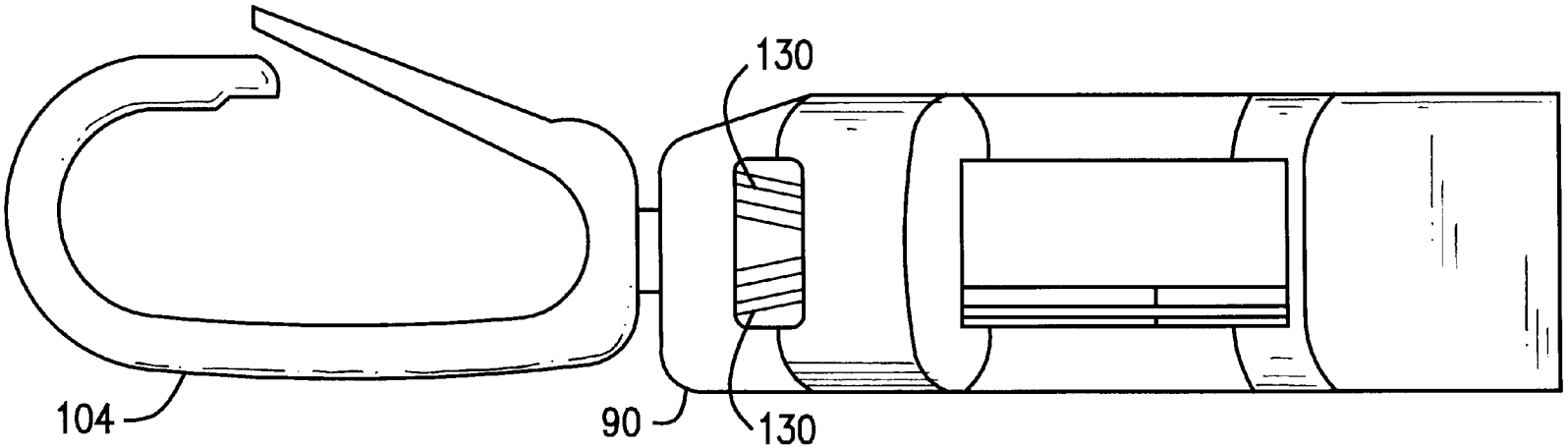
FIG. 12 shows a side view of the fifth exemplary attachment module of FIG. 11 coupled to an exemplary clip hook, according to the present invention.

FIG. 12 illustrates the exemplary clip hook 104 engaged with the attachment device mating section 90. Wings 130 are shown in their undeflected positions, thereby locking the clip hook 104 into the attachment module 6. An additional benefit of the post-wing mating section 122 used in this embodiment is that the clip hook 104 is afforded full rotational freedom, independent of the attachment module 6.

Figure 14:
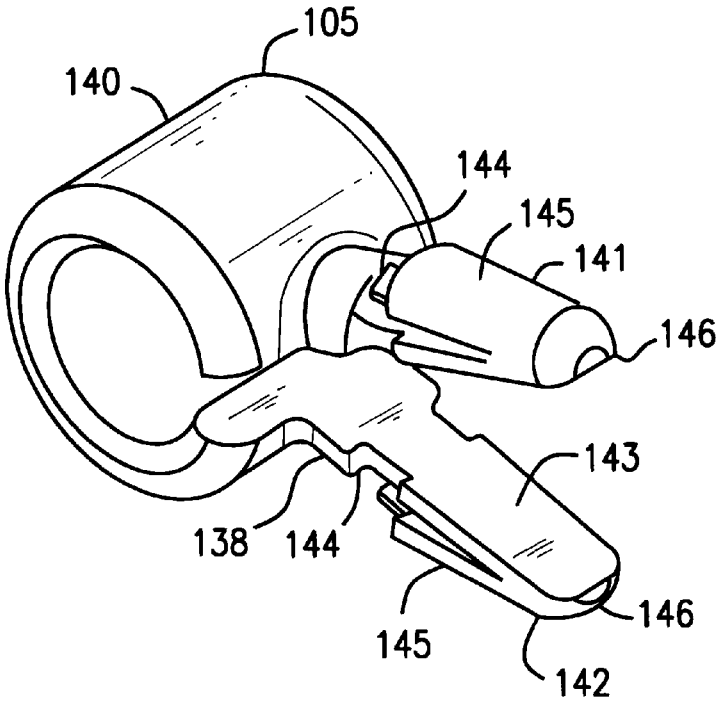
FIG. 14 shows a perspective view of an exemplary ring holder according to the present invention.
Figure 18:
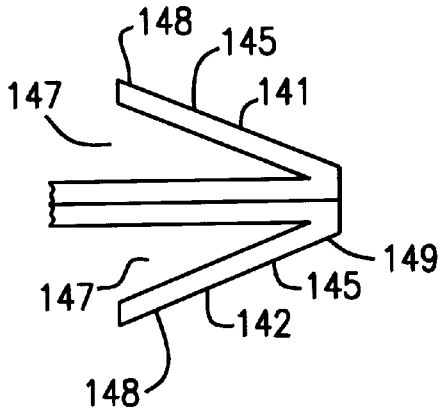
FIG. 18 shows a side cross-sectional view of a full dart mating section of the ring holder of FIG. 14, according to the present invention.

The fifth exemplary attachment module may be used with other types of attachment devices 101 as well. FIG. 14 illustrates a ring holder attachment device 105, which comprises a ring section 140 and upper and lower half-dart sections 141, 142. Each dart section has a flat opposing face 143, such that when pressed together, a full dart mating section 149 is formed (see FIG. 18). Each half-dart section 141, 142 comprises a half-stem 144 and a wing 145, with the wing 145 connected to the half-stem at a tip 146 of the half-stem 144 and extending backwardly from the tip 146 at an angle to the half-stem 144 such that a gap 147 is formed between the half-stem 144 and a back end 148 of the wing 145. Each wing 145 is inwardly (and outwardly) deflectable.

The exemplary ring holder 105 may be coupled to the attachment device mating section 90 by initially pressing the half-dart sections 141, 142 together to form the full dart mating section 149. The full dart mating section may then be inserted into through-hole 95 of the attachment device mating section 90, such that wings 145 contact the rim of through-hole 95. Continued insertion causes the wings 145 to inwardly deflect, eliminating the gap 147 and reducing the cross-section of the full dart mating section 149 so as to allow the wings 145 to enter the attachment module 6. Once the back ends 148 of the wings 145 have passed through the through-hole 95, the wings un-deflect, causing the cross-section of the full dart mating section 149 to return to its original size (which is larger than the through-hole 95). The ring holder 105 is thereby locked into the attachment module 6.

Figure 15:
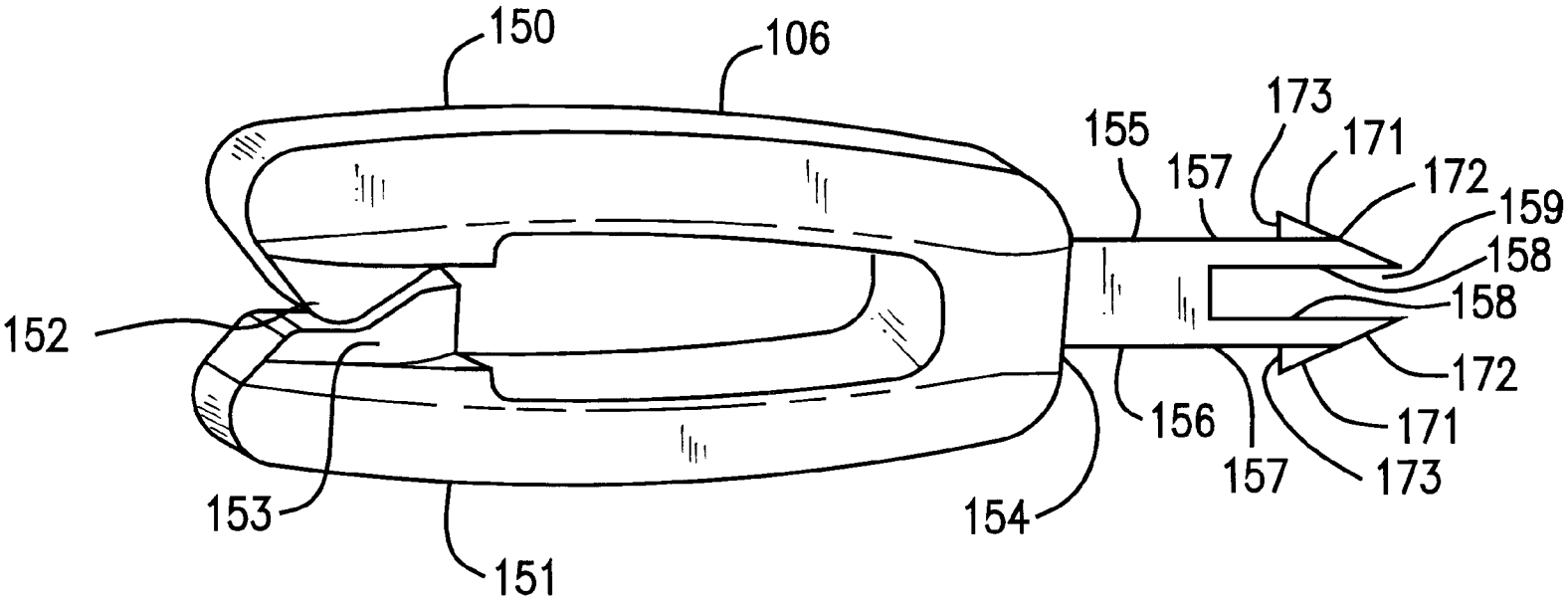
FIG. 15 shows a perspective view of an exemplary gripper clip according to the present invention.

FIG. 15 illustrates a gripper clip attachment device 106 which may also be used with the attachment module according to the present invention. Gripper clip device 106 comprises upper and lower arms 150, 151 which extend parallel to each other from a common base 154. At the ends of each arm 150, 151 is a respective gripper tooth 152, 153. The arms 150, 151 are biased such that the gripper teeth 152, 153 are in contact with each other. The arms 150, 151 are deflectable such that the gripper teeth 152, 153 may be separated from each other, thereby allowing an object to mounted within the gripper clip 106 (e.g., an ID badge or alligator clip).

A third type of mating section—a two prong snap mating section 155—extends from the common base 154 in the opposite direction of arms 150, 151. The mating section 155 comprises a cylindrical post 156 extending at a near end from the common base 154 and having two prongs 157 at a far end. The prongs 157 each have an opposing face 158, which together form a gap 159 between the two prongs 157. At the far end of each prong 157 is a tooth 171 having a sloped face 172 extending from the far end of the prong 157 outwardly and backwardly to a tooth back end 173. As a result, the mating section presents a cross-section at its widest point (i.e., the tooth back ends 173) that is larger than the diameter of through-hole 95.

To engage the gripper 106 with the exemplary attachment module 6, the mating section 155 is inserted into the through-hole 95 of the attachment device mating section 90. The sloped face 172 of each prong 157 will initially contact the through-hole 95 and present resistance to entry. With additional insertion force, the prongs 157 will deflect inwardly into the gap 159, causing the cross-section of the mating section 155 to decrease, until the mating section 155 may be passed through the through-hole 95. Once the back end 173 of each tooth 171 has passed through the through-hole 95, the prongs 157 un-deflect into their original positions, restoring the cross-section of the mating section 155 to its original size, and thereby locking the gripper 106 into the attachment module 6.

Figure 16:
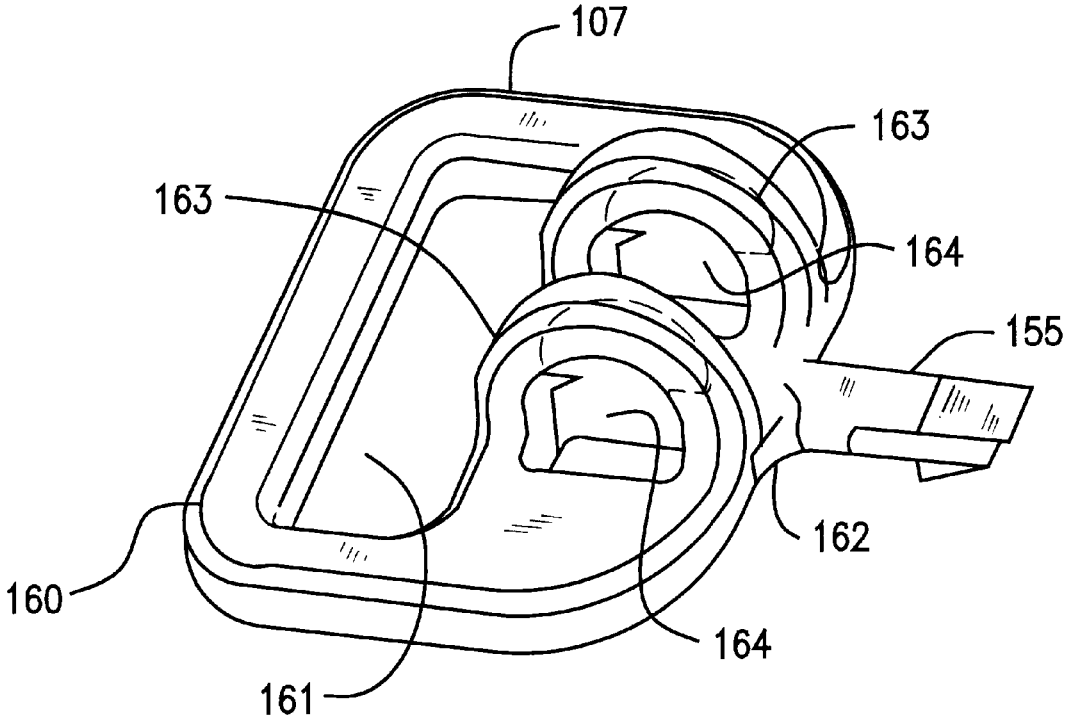
FIG. 16 shows a perspective view of an exemplary pin/loop attachment device according to the present invention.

FIG. 16 illustrates a pin/loop attachment device 107 which may also be used with the attachment module according to the present invention. Pin/loop attachment device 107 comprises a major loop 160 extending the width of the pin/loop attachment device 107, and connected to a base section 162 major loop 160 thus defines a hole 161 through the pin/loop attachment device 107. Two minor loops 163 extend from the base section 162 orthogonally to the major loop 160 and parallel to each other, each defining a hole 164. The holes 164 are in alignment, such that a pin or similar object may be inserted through both holes 164. A two prong snap mating section 155 is used to mount the pin/loop attachment device 107 to attachment device mating section 90, such as described above with respect to the gripper device 106.

As the above referenced illustrations and accompanying descriptions are exemplary, other similar embodiments are possible. For example, the fifth exemplary attachment device mating section 90 may be "switched" with the various post-wing/dart/two prong mating sections used for the attachment devices described above, such that the attachment device mating section 90 now comprises the respective post-wing/dart/two prong mating sections, and the attachment device 101 comprises the through-hole 95. In such a case, for example, the post-wing mating section 122 would be located extending from bottom plate 94, lieu of the through-hole 95. Structure would likewise be implemented in attachment devices 101 to prove a through-hole 95 in order to engage the post-wing mating section 122. Similar arrangements could be made to implement the exemplary full dart mating section 149 and the two prong snap mating section 155 as the attachment device mating section.

As can be seen from the previous examples, the exemplary modular system provides beneficial flexibility in the connection of a variety of attachment devices to cords, bands, etc. in a holding/display system. The exemplary modular system allows quick swapping of various attachment modules through the use of releasable clipping elements, and the use of interchangeable attachment modules which themselves may include various types of attachment devices, as desired by the manufacturer and/or user.

In the preceding specification, the invention has been described with reference to several specific exemplary embodiments thereof. It will, however, be evident that various modifications and changes may be made thereunto without departing from the broader spirit and scope of the invention as set forth in the claims that follow. For example, the exemplary modular system according to the present invention may be used in conjunction with other unillustrated attachment devices or releasable clipping assemblies, according to the teachings set forth above. The specification and drawings are accordingly to be regarded in an illustrative rather than restrictive sense.

What is claimed is:

1. A modular attachment system, comprising:

a base module having an attachment module mating section and a cord connection section, the cord connection section including a top piece and a bottom piece, the top and bottom pieces configured to engage a cord to the base module when the top piece is interlocked to the bottom piece; and an attachment module including a linking device and an attachment device, the linking device having a base module mating section and an attachment device mating section, the attachment device being configured to receive and support an object therein, the attachment device coupled to the linking device via the attachment device mating section;

wherein the attachment module mating section and the base module mating section together comprise a releasably connectable assembly, wherein the base module is coupled to the attachment module by engagement of the attachment module mating section and the base module mating section.

2. The modular attachment system of claim 1, wherein the top piece and bottom piece are pivotally connected by a pivot system.

3. The modular attachment system of claim 2, wherein the pivot system is a pin/hole arrangement.

4. The modular attachment system of claim 2, wherein the pivot system is a hinge arrangement.

5. The modular attachment system of claim 1, wherein the attachment device mating section includes a side through-channel.

6. The modular attachment system of claim 5, wherein the side through-channel is formed by an upper plate, a lower plate and a hinge piece.

7. The modular attachment system of claim 5, wherein the side through-channel is formed by an upper plate, a lower plate, and a bottom end connected between the upper plate and the lower plate.

8. The modular attachment system of claim 5, wherein the attachment device comprises a ring, and wherein the ring is coupled to the attachment module via the side through-channel.

9. The modular attachment system of claim 1, wherein the attachment device mating section comprises an upper plate and a lower plate, the upper plate and lower plate each including a tab at a lower end and extending in opposing fashion to define a narrow gap, the upper and lower plates defining a through-channel.

10. The modular attachment system of claim 1, wherein the attachment device mating section comprises a loop.

11. The modular attachment system of claim 10, wherein the attachment device comprises a webbing, and wherein the webbing is coupled to the linking device via the loop.

12. The modular attachment system of claim 1, wherein the attachment device mating system includes a front through-hole.

13. The modular attachment system of claim 12, wherein the attachment device mating section includes an upper plate, a lower plate, and a bottom plate connected to both the upper and lower plates, and wherein the through-hole is in the bottom plate.

14. The modular attachment system of claim 13, wherein the attachment device is coupled to the linking device via the through-hole.

15. The modular attachment system of claim 14, wherein the attachment device is a clip hook.

16. The modular attachment system of claim 14, wherein the attachment device is a ring holder.

17. The modular attachment system of claim 14, wherein the attachment device is a gripper clip.

18. The modular attachment system of claim 14, wherein the attachment device is a pin/loop attachment device.

19. The modular attachment system of claim 1, wherein the attachment device mating system includes a post-wing mating section, and the attachment device is coupled to the linking device via the post-wing mating section.

20. The modular attachment system of claim 1, wherein the attachment device mating system includes a full dart mating section, and the attachment device is coupled to the linking device via the full dart mating section.

21. The modular attachment system of claim 1, wherein the attachment device mating system includes a two prong snap mating section, and the attachment device is coupled to the linking device via the two prong snag mating section.

22. The modular attachment system of claim 1, wherein the attachment module mating section comprises a male side-releasable buckle clip and the base module mating section comprises a female side-releasable buckle clip.

23. The modular attachment system of claim 1, wherein at least one of the base module and the attachment module is constructed of molded plastic.

24. The modular attachment system of claim 1, wherein the base module includes a safety release system to allow the cord to disconnect from the cord connection section in the presence of a strong force.

25. The modular attachment system of claim 24, wherein the safety release system includes a tab formed in a base of the cord connection section.

26. A modular attachment system, comprising:

a base module having an attachment module mating section and a cord connection section;

an attachment module having a base module mating section and an attachment device mating section, the attachment device mating section comprising of a top member, a bottom member, and a closure member connected to an end of the bottom member, the closure member moving between an open and a closed position, securing the attachment device to the attachment module when in the closed position; and an attachment device configured to receive and support an object therein;

wherein the attachment module mating section and the base module mating section together comprise a releasably connectable assembly, and wherein the base module is coupled to the attachment module by engagement of the attachment module mating section and the base module mating section.

27. A modular attachment system, comprising:

a base module having an attachment module mating section and a cord connection section;

an attachment module having a base module mating section and an attachment device mating section, the attachment device mating section comprising of a top member and a bottom member, the top and bottom members each including a tab at a lower end and extending opposing fashion to define a narrow gap, the top and bottom members defining a through-channel; and an attachment device configured to receive and support an object therein;

wherein the attachment module mating section and the base module mating section together comprise a releasably connectable assembly, wherein the base module is coupled to the attachment module by engagement of the attachment module mating section and the base module mating section, and wherein the attachment device is coupled to the attachment module via the through-channel.

28. A modular attachment system, comprising:

a base module having an attachment module mating section and a cord connection section;

an attachment module having a base module mating section and an attachment device mating section, the attachment device mating section comprising an opening on a surface of the attachment module exposing an interior of the attachment module to an exterior of the attachment module; and an attachment device configured to receive and support an object therein, the attachment device having a post;

wherein the attachment module mating section and the base module mating section together comprise a releasably connectable assembly, wherein the base module is coupled to the attachment module by engagement of the attachment module mating section and the base module mating section, and wherein the attachment device is coupled to the attachment module by snapping the post into the opening.

* * * * *